United States Patent [19]

English

[11] Patent Number: 4,889,617

[45] Date of Patent: Dec. 26, 1989

[54] METHOD OF SUPPRESSING SODIUM POISONING OF CRACKING CATALYSTS DURING FLUID CATALYTIC CRACKING

[75] Inventor: Alan R. English, Point Richmond, Calif.

[73] Assignee: Chevron Research Company, San Francisco, Calif.

[21] Appl. No.: 843,463

[22] Filed: Mar. 24, 1986

[51] Int. Cl.[4] ..... C10G 11/18

[52] U.S. Cl. ..... 208/121; 208/52 CT; 208/113; 208/120

[58] Field of Search ..... 208/113, 120, 121, 52 CT, 208/149; 502/521, 516

[56] References Cited

U.S. PATENT DOCUMENTS

| | | | |
|---|---|---|---|
| 3,941,871 | 3/1976 | Dwyer et al. | 423/331 |
| 4,040,945 | 5/1977 | McKinney et al. | 208/120 |
| 4,101,417 | 7/1978 | Mitchell et al. | 208/120 |
| 4,244,810 | 1/1981 | Youngblood et al. | 208/52 CT |
| 4,252,635 | 2/1981 | Blanton, Jr. | 208/114 |
| 4,324,648 | 4/1982 | Roberts et al. | 208/113 |
| 4,466,884 | 8/1984 | Occelli et al. | 208/52 CT |

*Primary Examiner*—Anthony McFarlane

*Attorney, Agent, or Firm*—T. G. DeJonghe; Q. T. Dickinson

[57] ABSTRACT

A process is disclosed for passivating sodium contaminants in FCC feed using tin or tin compounds.

9 Claims, No Drawings

METHOD OF SUPPRESSING SODIUM POISONING OF CRACKING CATALYSTS DURING FLUID CATALYTIC CRACKING

SUMMARY OF THE INVENTION

Sodium poisoning of cracking catalysts, such as zeolite-containing catalysts, during fluid catalytic cracking of a hydrocarbon charge stock containing sodium contaminants is suppressed by depositing tin on the catalyst.

DESCRIPTION OF THE INVENTION

Catalytic cracking processes, such as those utilizing zeolite-containing catalyst compositions, are employed to produce gasoline and light distillate fractions from heavier hydrocarbon feedstocks. Deterioration occurs in the cracking catalyst which is partially attributable to the deposition on the catalyst of contaminants introduced into the cracking zone with the feedstock. The deposition of these contaminants such as sodium result in a decrease in the overall conversion of the feedstock as well as a decrease in the relative amount converted to the gasoline fraction.

Some contaminants, such as nickel, vanadium, copper, iron, and cobalt, are contained in the feed in organometallic form. Others, such as sodium, become mixed with the feed due to its close association with these contaminants prior to production, or contamination with other liquids or solids, such as seawater, during shipping or storage. Typically, sodium is removed from hydrocarbons by a desalting process prior to processing, but complete removal cannot always be accomplished due to high feed gravity, poor desalter operation, or prohibitive costs. Desalted feed can also become recontaminated without opportunity for redesalting. Processing sodium-contaminated feed in a catalytic cracking unit will cause the sodium in the feed to deposit onto the catalyst, where it will reduce catalyst activity and selectivity.

Sodium may also be introduced into the catalyst during its manufacture. Typically, most of this sodium-contamination is removed via ion exchange prior to use; this is an expensive process, however. Poor operation or cost reduction efforts often leave significant sodium in the final product catalyst. This contained sodium will behave much like sodium deposited from the feedstock when i0 the catalyst is used in a catalytic cracking unit.

As a general rule, it is necessary to replace unprotected contaminated catalyst with fresh catalyst at a rate sufficient to limit the amount of poisoning sodium on the catalyst in order to prevent an excessive deterioration in catalyst activity.

The fluid catalytic cracking process of our invention is carried out in a catalytic cracking system which includes a cracking zone and a separate catalyst regeneration zone, integral with the cracking zone, through which the catalyst is circulated for burning off deposited carbon. Our novel fluid cracking process can operate continuously for long periods of time at high catalyst activity notwithstanding a high sodium content in the hydrocarbon feed or on the catalyst. This continuous cracking procedure can be carried out with a relatively stabilized ratio of tin to sodium on the cracking catalyst within the specified range, this ratio being determined by the ratio of these metals introduced into the cracking system.

In a fluid catalytic cracking operation which continues over a relatively long period of time, catalyst is continuously or periodically removed from the system and replaced with an equal quantity of fresh make-up catalyst at a sufficient rate, as determined by analytical or empirical evidence obtained from the cracking operation, to maintain suitable overall catalyst activity. Without catalyst replacement in a continuing operation, catalyst exhaustion is inevitable. In view of this catalyst replacement, the average concentration of both sodium and tin on the catalyst at any given moment under steady state operation depends on the concentration of sodium in the feedstock, the concentration of sodium in the make-up catalyst, the rate of tin addition to the system, and the rate of catalyst replacement.

A particular advantage of our process is that it enables us to conduct a fluid cracking operation on a hydrocarbon feed and maintain a high activity of the cracking catalyst to the desired, more volatile products, notwithstanding the fact that the catalyst has an exceptionally high content of deposit sodium. As a result of this substantial improvement in tolerance of the catalyst to sodium poisoning, the fluid catalytic cracking operation can be carried out with a significant reduction in the rate of catalyst replacement, over the rate which would otherwise be required for activity maintenance of a non-protected catalyst. This reduction in catalyst requirements results in a substantial saving in catalyst costs as well as savings in overall process costs.

Our process is especially suitable for use with feedstocks having a high sodium content. Additionally, heavy hydrocarbon feed materials containing high levels of sodium can be economically cracked by our process. This permits the economical upgrading of high sodium content oils which would otherwise be economically unattractive or require additional processing in a fluid cracking process with a zeolitic cracking catalyst, an undertaking that is not possible with an unprotected catalyst.

In our process the tin is added to the cracking system by adding a tin compound to the cracking reactor, either in the feed stream itself or in a separate stream to the cracking reactor, or by injecting a tin compound directly into the regenerator. Organic compounds of tin which are soluble in the process hydrocarbons are the most preferred. For convenience in handling, these compounds can be dissolved in a suitable quantity of a hydrocarbon solvent such as benzene, toluene, or a hydrocarbon fraction that is recovered from the cracking operation. The tin solution can then be more easily metered into the system at the desired rate. Alternatively, the tin compound can be impregnated onto the replacement catalyst by a conventional, suitable impregnation technique prior to the catalyst's use. In this instance, the amount of tin that is deposited on the catalyst is correlated both with the catalyst replacement rate and with the rate that vanadium contaminant is fed to the reactor. Alternatively, tin compounds can also be injected into any other section of the unit where eventual contact with the catalyst will result, or solid forms of tin metal or tin compounds may be used. The amount of tin that is used to passivate the sodium on the catalyst is determined by analyzing the feed stream and fresh catalyst for sodium. The tin compound is then metered into the cracking unit or into the regenerator at a rate which is within the broad range of bout 0.005:1 to about 2:1 parts of tin per part of sodium in the feed stream. However, for superior results, it is preferred to feed the tin compound at a rate which is within the more restricted range of about 0.01:1 to about 1:1 parts of tin per part of sodium in the hydrocarbon feed.

Any tin compound, containing organic groups, inorganic groups or containing both types of groups, which suppresses the catalyst deactivating effect of the poisoning metals can be used. Water-soluble compounds of tin and even insoluble tin metal are useful. The useful inorganic groups include oxide, sulfide, selenide, telluride, sulfate, nitrate and the like. The halides are also useful but are less preferred. The organic groups include alkyl having from one to twelve carbon atoms, preferably one to six carbon atoms; aromatic having from six to eight carbon atoms, preferably phenyl; and organic groups containing oxygen, sulfur, nitrogen, phosphorus or the like.

Suitable organic tin compounds include tetraethyl tin, tetrapropyl tin, tetrabutyl tin, tetraphenyl tin, bis(tributyl tin) oxide, bis(triphenyl tin) sulfide, dibutyl tin oxide, dibutyl tin sulfide, diethyldiisoamyl tin, diethyldiisobutyl tin, diethyldiphenyl tin, diethyl tin, butyl tin trichloride, dibenzyl tin dibromide, diethyl tin difluoride, diethyl tin oxide, diphenyl tin sulfide, aromatic sulfonates such as stannous benzenesulfonate, tin carbamates such as stannous diethylcarbamate, tin thiocarbamates such as stannous diethyldithiocarbamate and dibutyl tin diamyldithiocarbamate, phosphites and phosphates such as stannous diethylphosphite and stannous diphenyl phosphate, thiophosphates, compounds such as dibutyl tin bisdienpropylphosphorodithiate, dibutyl tin bis(isooctyl mercaptoacetate), and the like.

The catalysts used in the cracking processes of this invention may include zeolitic-containing catalysts wherein the concentration of the zeolite is in the range of 6 to 100 weight percent of the catalyst composite and which have a tendency to be deactivated by the deposition thereon of contaminants as previously described, to the extent that optimum gasoline product yields are no longer obtained. The cracking catalyst compositions include those which comprise a crystalline aluminosilicate dispersed in a refractory metal oxide matrix such as disclosed in U.S. Pat. Nos. 3,140,249 and 3,140,253 to C. J. Plank and E. J. Rosinski. Suitable matrix materials comprise inorganic oxides such as amorphous and semicrystalline silica-aluminas, silica-magnesias, silica-alumina-magnesia, alumina, titania, zirconia, and mixtures thereof.

Zeolites or molecular sieves having cracking activity and suitable in the preparation of the catalysts of this invention are crystalline, three-dimensional, stable structures containing a large number of uniform openings or cavities interconnected by smaller, relatively uniform holes or channels. The formula for the zeolites can be represented as follows:

$$xM_2/_nO:Al_2O_3:1.5\text{–}6.5\ SiO_2:yH_2O$$

where M is a metal cation and n its valence; x varies from 0 to 1; and y is a function of the degree of dehydration and varies from 0 to 9. M is preferably a rare earth metal cation such as lanthanum, cerium, praseodymium, neodymium or mixtures thereof.

Zeolites which can be employed in the practice of this invention include both natural and synthetic zeolites. These natural-occurring zeolites include gemelinite, chabazite, dachiardite, clinoptilolite, faujasite, heulandite, analcite, levynte, erionite, sodalite, cancrinite, nepheline lazurite, scolecite, natrolite, offretite, mesolite, mordenite, brewsterite, ferrierite, and the like. Suitable synthetic zeolites which can be employed in the inventive process include zeolites, X, Y, A, L, ZK-4, B, E, F, H, J, M, Q, T, W, Z, alpha and beta, ZSM-types and omega. The effective pore size of synthetic zeolites is suitable between 6 and 15Å in diameter. The term "zeolites" as used herein contemplates not only aluminosilicates but substances in which the aluminum is replaced by gallium, and substances in which the silicon is replaced by germanium. The preferred zeolites are the synthetic faujasites of the types Y and X or mixtures thereof.

It is also well known in the art that to obtain good cracking activity, the zeolites must be in good cracking form. In most cases this involves reducing the alkali metal content of the zeolite to as low a level as possible, as a high alkali metal content reduces the thermal structural stability, and the effective lifetime of the catalyst is impaired. Procedures for removing alkali metals and putting the zeolite in the proper form are well known in the art and are as described in U.S. Pat. No. 3,537,816.

Conventional methods can be employed to form the catalyst composite. For example, finely divided zeolite can be admixed with the finely divided matrix material, and the mixture spray dried to form the catalyst composite. Other suitable methods of dispersing the zeolite materials in the matrix materials are described in U.S. Pat. Nos. 3,271,418; 3,717,587; 3,657,154; and 3,676,330, whose descriptions are incorporated herein by reference thereto.

In addition to the zeolitic-containing cracking catalyst compositions heretofore described, other materials useful in preparing the tin-containing catalysts of this invention also include the laminar 2:1 layer-lattice aluminosilicate materials described in U.S. Pat. No. 3,852,405. The preparation of such materials is described in the said patent, and the disclosure therein is incorporated in this application by reference thereto. When employed in the preparation of the catalysts of this invention, such laminar 2:1 layer-lattice aluminosilicate materials are combined with a zeolitic composition.

As used herein, "fluid catalytic cracking system" or "catalytic cracking system" is used with reference to the overall integrated reaction system, including the catalytic reactor unit, the regenerator unit and the various integral support systems and interconnections. The cracking essentially occurs in a vertical, elongated reactor tube, generally referred to as the riser. Steam and the charge stock together with recirculating, regenerated catalyst are introduced into the bottom of the riser and quickly pass to the top and out of the riser. The catalyst quickly separates from the gases and passes to a bed of the catalyst in the regenerator unit where carbon is burned off with injected air. Means for catalyst removal and addition of make-up catalyst are provided in the regenerator unit. The temperature in the catalytic reactor is suitably between about 900° F. and about 1100° F., and the temperature in the regenerator is suitably between about 1050° F. and about 1450° F. A suitable reaction system is described and illustrated in U.S. Pat. No. 3,944,482, which description and illustration are incorporated herein by reference.

A successful fluid catalytic cracking operation can be run continuously for an indefinite period of time such as for many months or even years if the catalyst is gradually replaced at a rate which is designed to maintain a desirable level of catalyst activity. This means that the average amount of poisoning sodium on the catalyst is maintained within an acceptable level. In general, the level of poisoning sodium on an unprotected zeolite-containing cracking catalyst is maintained at a maximum of about 3,000 ppm or lower to prevent excessive catalyst poisoning. However, zeolite-containing cracking catalysts which are protected by this invention can be successfully utilized at a sodium level as high as 30,000 ppm and even higher without exhibiting an unacceptable conversion loss or loss of gasoline production.

The tin compound can be conveniently metered into the hydrocarbon feed stream and fed into the catalytic reactor with this hydrocarbon stream. Since the tin compound is used in such small quantities, it is convenient to utilize a diluted solution of the tin compound in a suitable solvent, such as benzene or gasoline. However, the tin compound can also be injected into the cracking zone with the steam as a separate stream. The tin compound, or metallic tin, can also be injected into the catalyst regeneration zone. Regardless of where the tin is introduced into the cracking system, it will deposit onto the cracking catalyst and perform the passivating effects of this invention.

After the tin compound is introduced into the catalytic cracking system, whether in the cracking zone or in the regeneration zone, the tin will deposit onto the catalyst generally by a process which includes the decomposition of the tin compound. Since all of the catalyst is treated with an oxygen-containing gas, usually air, in the regeneration zone at an elevated temperature, all of the tin which does not react with the catalyst components is believed to be converted on the catalyst surface to tin oxide.

The catalyst compositions of this invention are employed in the cracking of charge stocks, in the absence of added hydrogen, to produce gasoline and light distillate fractions from heavier hydrocarbon feedstocks. The charge stocks generally are those having an average boiling temperature above 600° F. (316° C.) and include materials such as gas oils, cycle oils, residuums and the like.

Although not to be limited thereto, the fluid catalytic cracking process of this invention is preferably carried out using riser outlet temperatures between about 900° to 1100° F. (482° to 593° C.). Under the fluid catalytic cracking conditions, the cracking occurs in the presence of the fluidized catalyst in an elongated reactor tube commonly referred to as a riser. Generally, the riser has a length-to-diameter ratio of about 20. The charge stock is passed through a preheater, which heats the feed to a temperature of about 600° F. (316° C.), and the heated feed is then charged into the bottom of the riser.

In operation, a contact time (based on feed) of up to 15 seconds and catalyst-to-oil weight ratios of about 4:1 to about 15:1 are employed. Steam can be introduced into the oil inlet line to the riser and/or introduced independently to the bottom of the riser so as to assist in carrying regenerated catalyst upwardly through the riser. Regenerated catalyst at temperatures generally between about 1100° and 1350° F. (593° to 732° C.) is introduced into the bottom of the riser.

The riser system at a pressure in the range of about 5 to about 50 psig (0.35 to 3.50 kg/cm$^2$) is normally operated with catalyst and hydrocarbon feed flowing concurrently into and upwardly into the riser at about the same flow velocity, thereby avoiding any significant slippage of catalyst relative to hydrocarbon in the riser and avoiding formation of a catalyst bed in the reaction flow stream.

The riser temperature drops along the riser length due to heating and vaporization of the feed, by the slightly endothermic nature of the cracking reaction, and by heat loss to the atmosphere. As nearly all the cracking occurs within one or two seconds, it is necessary that feed vaporization occurs nearly instantaneously upon contact of feed and regenerated catalyst at the bottom of the riser. Therefore, at the riser inlet, the hot, regenerated catalyst and preheated feed, generally together with a mixing agent such as steam, nitrogen, methane, ethane or other light gas, are intimately admixed to achieve an equilibrium temperature nearly instantaneously.

The catalyst containing metal contaminant and coke is separated from the hydrocarbon product effluent, withdrawn from the reactor and passed to a regenerator. In the regenerator the catalyst is heated to a temperature in the range of about 800° to about 1600° F. (427° to 871° C.), preferably about 1160° to about 1350° F. (627 to 682° C.), for a period of time ranging from three to thirty minutes in the presence of a free-oxygen containing gas. This burning step is conducted so as to reduce the concentration of the carbon on the catalyst, preferably to less than about 0.3 weight percent, by conversion of the carbon to carbon monoxide and/or carbon dioxide.

Conventional cracking processes can operate with unprotected catalysts containing high sodium levels but at a substantial loss of product distribution and conversion. By employing the process of this invention, a conversion and gasoline yield can be obtained at a relatively high sodium level on the catalyst which is equivalent to the conversion and gasoline yield normally effected by unprotected catalysts containing lower amounts of sodium contaminant.

As previously indicated, this invention has a significant advantage over conventional catalytic cracking processes by providing an economically attractive method to include sodium-content oils as a feed to the catalytic cracking process. Because of the loss of selectivity to high value products (loss of conversion and reduced gasoline yield) with the increase in sodium contamination on conventional cracking catalysts, most refiners attempt to maintain a low sodium level on the cracking catalyst. This invention therefore allows the refiner to process higher sodium containing feeds, or process the same feeds at a lower catalyst makeup rate and hence lower catalyst cost. Since stocks with high sodium also often contain other metal contaminants, and because reduced catalyst makeup rates will result in higher levels of other metal poisons on catalyst, it may be desirable to employ this invention in conjunction with other metal passivators, such as antimony, bismuth, phosphorus, sulfur or light gases, which are known or may become known, in the art. This invention should be beneficial when used along with these other passivators.

EXAMPLES

To demonstrate the efficacy of our invention in reducing the poisoning effect of sodium, we have run tests on a Microactivity Test Unit and provide an example of how this invention might be used in a commercial catalytic cracking unit. The feedstock and catalyst used for the tests are described in Tables I and II. Operating conditions used on the Microactivity Test Unit are shown in Table III.

TABLE I

| Catalyst Inspections | |
|---|---|
| Surface Area: sq. meters/gram | 200 |
| Pour volume: cc/gram | 0.22 |
| Apparent Bulk Density: g/cc | 0.75 |

TABLE II

| Feedstock Inspections | |
|---|---|
| Type | Mid |
| Continent | |
| | Gas Oil |
| Gravity: API | 27.9 |
| Sulfur: wt % | 0.6 |
| Nitrogen: wt % | 0.1 |
| Carbon Residue: Ramsbottom: wt % | 0.3 |
| Pour Point: °F. | +100 |
| Distillation: D1160, °F. | |
| 10% | 595 |
| 30% | 685 |
| 50% | 765 |
| 70% | 845 |
| 80% | 934 |

EXAMPLE 1

This example demonstrates the poisoning effect of sodium on FCC catalyst activity and gasoline selectivity. Portions of the catalyst described in Table II were doped with sodium by wet impregnation of sodium acetate in water, at several levels of sodium. This was followed by oven drying at 250° F. These portions and a portion of catalyst without added sodium were calcined at 1000° F., and then steam-aged with 95 percent steam at 1350° F. for 14 hours. Each portion of catalyst was then run in a Microactivity Test Unit with the feed described in Table I and the conditions described in Table III. The following results were obtained:

| Added Sodium on Catalyst: wt % | Conversion: vol % FF | Gasoline: vol % FF |
|---|---|---|
| 0.00 | 78.6 | 61.2 |
| 0.50 | 77.2 | 62.2 |
| 1.00 | 74.0 | 59.5 |
| 2.00 | 68.8 | 57.6 |

The increase in gasoline yield obtained with 0.5 wt % sodium is due to a decrease in the amount of overcracking obtained with the highly active fresh catalyst.

EXAMPLE 2

Example 2 demonstrates the use of tin to partially reduce the poisoning effect of deposited sodium. Samples of catalyst were prepared with portions of the catalyst described in Table II, by the same procedure described in Example 1, except that tin, in the form of hexabutylditin, was added to the sample by wet impregnation with hydrocarbon and oven dried, prior to the addition of the sodium. These samples were then tested in the MAT unit and compared to the results obtained in Example 1. The following results were obtained:

| Tin Added on Catalyst: wt % | Added Sodium on Catalyst: wt % | Conversion vol % FF | Gasoline vol % FF |
|---|---|---|---|
| 0.00 | 0.50 | 77.2 | 62.2 |
| 0.25 | 0.50 | 77.8 | 63.2 |
| 0.00 | 1.00 | 74.0 | 59.5 |
| 0.50 | 1.00 | 76.1 | 61.0 |

In ease case superior cracking results were obtained when tin was present to reduce the effect of sodium.

EXAMPLE 3

It is known in the art that tin can be used to partially reduce the catalyst poisoning effects of vanadium. Example 3 demonstrates that the sodium passivation benefits of this invention can be obtained in conjunction with the known passivation effects of tin on vanadium. Samples of catalyst were prepared with portions of the catalyst described in Table II, by the same procedure described in Example 2, except that vanadium, in the form of vanadium naphthenate, was added to the sample by wet impregnation with hydrocarbon and oven dried, prior to the addition of the sodium. These samples were then tested in the MAT unit under conditions given in Table III. The following results were obtained:

| Tin Added on Catalyst: wt % | Added Sodium on Catalyst: wt % | Added Vanadium on Catalyst: wt % | Conversion: vol % FF | Gasoline: vol % FF |
|---|---|---|---|---|
| 0.00 | 1.00 | 1.00 | 29.8 | 21.5 |
| 0.50 | 1.00 | 1.00 | 36.6 | 25.8 |

It can be seen that catalyst performance improvement is obtained despite the presence of both sodium and vanadium.

What is claimed is:

1. A cracking process which comprises contacting a hydrocarbonaceous feed containing sodium contaminants with a cracking catalyst or employing catalyst with sodium contaminants under cracking conditions, without added hydrogen, to produce a product fraction lighter than the feed in the cracking system, including a reactor and a catalyst regeneration zone in which the catalyst is circulated from the reactor to the regeneration zone and back to the reactor, wherein a passivating agent consisting essentially of tin is present in the cracking process in an amount sufficient to reduce the contaminating effect of the sodium deposited on the catalyst by the feed.

2. The process of claim 1 wherein the tin is present in a ratio between 0.005:1 to 2:1 of tin to sodium on said catalyst.

3. The process of claim 1 wherein the tin is present in a ratio between 0.05:1 to 2:1 of tin to sodium on said catalyst.

4. The process of claim 1, 2 or 3 wherein the tin is present as a tin compound or metal with the feed.

5. The process of claim 1, 2 or 3 wherein the tin is present as a tin compound or metal to the regeneration zone.

6. The process of claim 1, 2 or 3 wherein the tin is incorporated into the catalyst.

7. The process of claim 1 wherein additional metal passivators are also employed to reduce the effects of other catalyst poisons present in the feed.

8. The process of claim 7 wherein the catalyst poisons are selected from the group consisting of nickel, vanadium, iron, copper, zinc, lead and nitrogen.

9. The process of claim 7 where the metal passivators are selected from the group consisting of antimony, bismuth, phosphorus, or sulfur.

* * * * *